United States Patent [19]

Nicolaisen et al.

[11] 4,039,791

[45] Aug. 2, 1977

[54] ELECTRIC SNAP SWITCH

[75] Inventors: Holger Nicolaisen; Finn Schnoor Andersen, both of Nordborg; Jens Peter Jensen, Augustenborg, all of Denmark

[73] Assignee: Danfoss A/S, Nordborg, Denmark

[21] Appl. No.: 620,870

[22] Filed: Oct. 9, 1975

[30] Foreign Application Priority Data

Oct. 28, 1974 Germany ..... 2451107

[51] Int. Cl.[2] ..... H01H 13/36

[52] U.S. Cl. ..... 200/67 D

[58] Field of Search ..... 220/67 R, 67 D; 337/319, 347, 368, 392

[56] References Cited

U.S. PATENT DOCUMENTS 2,110,674 3/1938 Miller et al. ..... 200/67 D

*Primary Examiner*—David Smith, Jr.

[57] ABSTRACT

The invention relates to an electric snap switch assembly. The assembly includes a two part carrier unit with at least one leaf spring mounted in one of the carrier parts. The other carrier part is spaced from the free end of the leaf spring and a bearing is mounted on the second carrier part in spaced relation to and in the same plane as the leaf spring. An omega spring is mounted between the bearing and the leaf spring, and bearing control means are provided for moving the bearing in any direction in the plane of the leaf spring.

2 Claims, 3 Drawing Figures

ELECTRIC SNAP SWITCH

The invention relates to an electric snap switch in which a snap compression spring such as an omega spring is mounted on one side at a snap-over strut and is supported on the other side in a counterbearing which is held by a carrier and is adjustable relatively thereto substantially in the compression direction by means of a screw and substantially in the snap direction by means of a rotary adjusting device In such snap switches, a multi-part snap system is disposed between two points of articulation. There are snap systems in which two fixed struts are provided apart from the snap spring; other snap systems have only one fixed strut in addition to the sanp spring. A two-part snap system has the advantage of a simpler construction but must generally be adjusted more accurately than the three-part snap system. The present invention is particularly suitable for two-part snap systems.

A snap switch with a two-part snap system is known, in which the counterbearing is formed at the free end of a spring yoke and the housing serves as a carrier for the counterbearing. A first adjusting screw that is adjustable in the snap direction serves to fix the spring yoke to the housing. A second adjusting screw which is adjustable substantially in the compression direction presses on the spring yoke near the free end.

When this snap switch is adjusted at the end of manufacture, the adjusting tools must be offered at two positions that are displaced through 90° . Generally, the housing must be tilted after setting the first adjusting screw in order to reach the second adjusting screw. Since adjustment is to take place very rapidly and is often expedited by means of a tool driven by a motor which is switched off when the desired value has been reached, the position of the adjusting screws causes a delay. Further, it is not possible to provide a second snap system adjacent the first snap system because part of the space required for this is taken up by the spring yoke and the screw holding same.

The invention is based on the object of providing an electric snap switch of the aforementioned kind in which adjustment is facilitated in that the adjusting tools can be offered from one side and in which, by reason of a space-saving arrangement, it is also possible to dispose two or more snap systems at a close spacing offset from one another in the snap direction.

This object is achieved according to the invention in that the carrier comprises a slot in which at least portion of a plate guided in the snap direction is held under friction, that the plate receives in a tapped hole the screw for adjusting the counterbearing in the compression direction, and that in the carrier there is provided for the adjusting device a bearing which has an axis parallel to the screw and which by means of a deflecting device converts rotation about the bearing axis to displacement of the plate in the snap direction.

In this construction both adjustments are carried out from one side. The screw and bearing for the adjusting device are disposed directly adjacent one another and are therefore readily accessible either simultaneously or one after the other. The parts necessary for the adjustment lie beyond the projection of the snap system so that several snap systems can be provided which are offset from one another in the snap direction and the adjustment of which can be carried out from the same side.

For deflection purposes various devices are possible, for example a pinion in mesh with teeth on the plate. However, a particularly simple deflecting device is obtained if a circular disc disposed eccentrically to the bearing axis engages in an elongated hole of the plate extending transversely to the snap direction. In such an eccentric arrangement, displacement of the plate is not proportional to the rotation of the adjusting device but this is insignificant because the setting is generally checked with the aid of values of the snap system.

In a preferred embodiment the circular disc is a pin having a smaller diameter than the bearing and is disposed completely within the bearing cross-section. A tool can then be employed which may be driven by a motor that switches off when the desired value has been reached, is introduced only during adjustment, and has at the front end a cylinder with the same diameter as the bearing and the pin mounted eccentrically thereto.

It is desirable if the plate is fully received in the slot and the carrier has adjacent the bearing an elongated hole extending in the snap direction for the passage of the screw. This elongated hole permits the plate to be displaced in the clamping direction without obstruction by the screw.

It is of particular advantage if the carrier receives at least two plates for the counterbearings of the snap compression springs of at least two snap systems which each consist of only two snap members, namely the snap compression spring and the snap-over strut, and are actuatable by a common setting element engaging one end of the snap systems. In this way it is first of all possible to allow two or more two-part snap systems to be adjusted by a common setting element and yet give each snap system an accurate adjustment in two coordinate directions. In particular, one can adjust very accurately the distances to be covered by the setting element between the actuation of two snap systems.

In particular, the carrier can form the setting element. Since the carrier can be made small and light despite the adjusting device installed thereon, it is possible to use it as a setting element that is to be operated from the outside.

Preferably the carrier is adjustable by a heatable bimetallic element to form a time switch with several switching periods. The bimetallic element bends away according to a time function. The path travelled by the carrier leads to different switching times for the individual snap systems depending on the set position of the counterbearing.

If the carrier is of plate form and held by two bimetallic leaf springs, namely a heated bimetallic leaf spring and a compensating bimetallic leaf spring, which each engage an end of the plate and receive the snap systems between each other, a compact construction will be obtained for a snap switch with a plurality of snap systems.

The invention will now be described in more detail with reference to an example shown in the drawing. In the drawing,.

Figure 1:
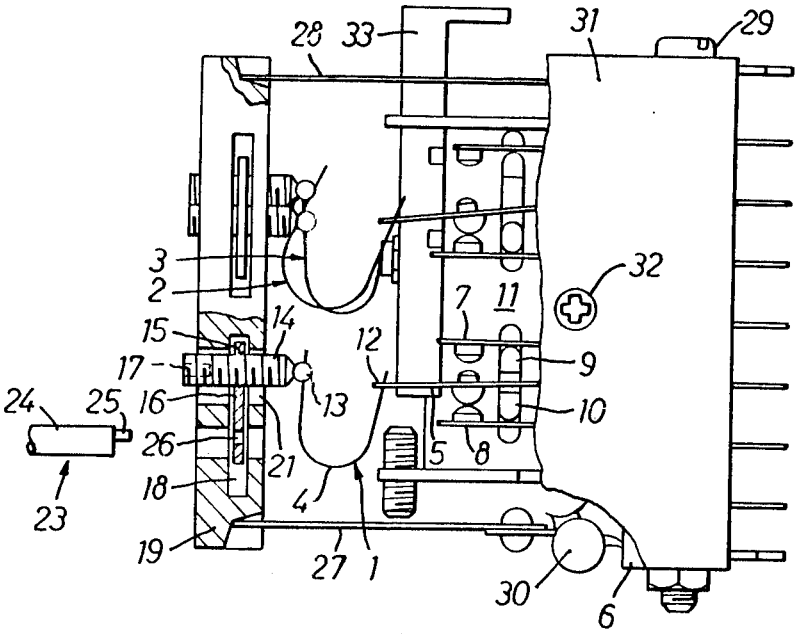
FIG. 1 is a part-sectional side elevation on the line A—A in FIG. 2.
Figure 2:
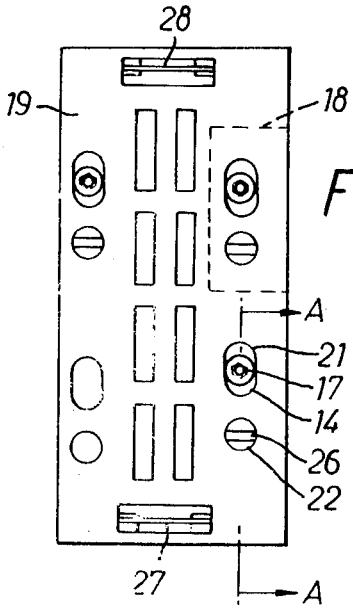
FIG. 2 is an end elevation of the carrier for the counterbearing.
Figure 3:
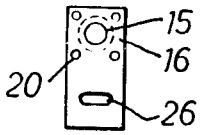
FIG. 3 is a plan view of a displaceable plate.

The example illustrates a time switch with three consecutively switching snap systems 1, 2 and 3. Each snap system consists of a snap compression spring 4 in the form of an omega or U spring and a snap-over strut 5 which is clamped in a carrier 6 and is in the form of a snap-over contact spring. It co-operates with two contact springs 7 and 8 which, in their positions of rest, lie with pretentions against two abutments 9 or 10 formed on an intermediate wall 11 connected to the carrier 6. This wall also covers the contacts of the third snap system 3.

The snap-over strut 5 in the form of a leaf spring is rigidly clamped in the carrier 6. With the snap compression spring 4, it forms a hinge 12. The other side of the snap compression spring 4 rests at a counterbearing 13. The counterbearing 13 is seated at a screw 14 screwed into a tapped hole 15 of a plate 16 and having an internal hexagon on the opposite side. The plate is held under friction in a slot 18 which is open at one side and is provided in a plate-shaped carrier 19, the plate being so guided in this slot that it is displaceable in the snap direction (perpendicular to the plane of the drawing). To achieve the friction grip, four pimples 20 are pressed out of the plate. To permit displacement, the screw 14 extends through an elongated hole 21 in the carrier 19. A cylindrical bearing 22 for an adjusting device 23 is provided adjacent the elongated hole. The adjusting device comprises a cylinder 24 fitting into the bearing 22 and a circular disc 25 which is eccentrically mounted at the end of the cylinder and is in the form of a pin having a smaller diameter than the bearing 22. This pin lies completely within the cross-section of the cylinder 24. The pin-like circular disc 25 can engage in an elongated hole 26 extending transversely to the snap direction in the displaceable plate 16.

Near its ends, the carrier 19 is connected to the respective free end of a bimetallic leaf spring 27 and 28. These leaf springs are held to the carrier 9 with the aid of a screw 29. A heating element 30 serves to heat the bimetallic leaf spring 27. The bimetallic leaf spring 28 is deflected in the opposite direction and is subjected only to room temperature; it therefore serves to compensate for the room temperature. the resulting motion of the bimetallic leaf springs is transmitted to the carrier 19. The latter causes displacement of the counterbearing 13, whereby the three snap systems 1, 2 and 3 operate successively. For example, the snap switch can be used in a control device for a furnace installation in which the one snap system operates at the end of the preignition period, the second snap system operates at the end of the post-ignition period and the third snap system operates at the end of the safety period.

the illustrated snap switch also comprises a pair of side walls 31, which are fixed by means of a cross-head screw 32, and a resetting slide 33 which serves for manually resetting one of the snap systems used as a safety switch-off. After assembly of the snap switch, adjustment of the switching difference or the contact pressure is effected by setting the screw 14 in the compression direction of the snap compression spring 4. For this purpose a tool with a hexagonal head is inserted in the hexagonal hole 17 of the screw 14 and turned, for example also by a motor, until the desired value has been obtained. Adjustment of the point of application of the snap system is then effected in that a tool with the adjusting device 23 is inserted in the bearing 22 and the elongated hole 26. The bimetallic leaf spring 27 is heated. After reaching the desired switching period, the adjusting device 23 is rapidly turned until snapping over occurs. The drive can for example take place with the aid of a motor which is switched off on snapping over.

We claim:

1. An electric snap switch assembly comprising a carrier unit having first and second parts at least one leaf spring mounted in said first carrier part, said second carrier part being spaced from the free end of said leaf spring, a movable bearing mounted on said second carrier part in spaced relation to and in the same plane as said leaf spring, an omega spring mounted between said bearing and said leaf spring, and bearing control means for moving said bearing a first direction towards said spring and in a second direction transversely of said first direction, said bearing control means including a slot and a movable plate in said second carrier part with said plate having a locus normal to said leaf spring, said bearing control means including a screw rotatably mounted in said plate, said bearing being at one end of said screw, cam means for adjustably moving said plate, said cam means including a shaft rotatably mounted in said second carrier part and an elongated slot in said plate, said cam means including a pin which engages said plate slot and is eccentrically mounted on said pin.

2. An electric snap switch assembly according to claim 1 wherein said first and second carrier parts are joined by limited leaf springs.

* * * * *